US011056306B2

(12) United States Patent
Gaudinat et al.

(10) Patent No.: US 11,056,306 B2
(45) Date of Patent: Jul. 6, 2021

(54) PYROTECHNIC SWITCH WITH A FUSE ELEMENT

(71) Applicant: Autoliv Development AB, Vargarda (SE)

(72) Inventors: Francois Gaudinat, Amblainville (FR); Jean Champendal, Quimper (FR); Sebastien Menestre, Landerneau (FR); Ludovic Lageat, Brest (FR); Etienne Dugast, Nogent-sur-Marne (FR); Gildas Clech, Plougastel-Daoulas (FR); Catherine Lebarh, Quimper (FR)

(73) Assignee: Autoliv ASP, Inc., Ogden, UT (US)

( * ) Notice: Subject to any disclaimer, the term of this patent is extended or adjusted under 35 U.S.C. 154(b) by 0 days.

(21) Appl. No.: 16/494,896

(22) PCT Filed: Mar. 14, 2018

(86) PCT No.: PCT/EP2018/056436
§ 371 (c)(1),
(2) Date: Sep. 17, 2019

(87) PCT Pub. No.: WO2018/167169
PCT Pub. Date: Sep. 20, 2018

(65) Prior Publication Data

US 2020/0035437 A1 Jan. 30, 2020

(30) Foreign Application Priority Data

Mar. 17, 2017 (FR) ..... 1752219

(51) Int. Cl.
*H01H 85/02* (2006.01)
*H01H 39/00* (2006.01)
*H01H 85/38* (2006.01)

(52) U.S. Cl.
CPC ..... *H01H 85/0241* (2013.01); *H01H 39/00* (2013.01); *H01H 85/38* (2013.01); *H01H 2039/008* (2013.01)

(58) Field of Classification Search
CPC .... H01H 39/00; H01H 39/004; H01H 39/006; H01H 2039/008; H01H 85/0241
See application file for complete search history.

(56) References Cited

U.S. PATENT DOCUMENTS 4,224,491 A 9/1980 Kroon
6,418,005 B1 7/2002 Endo et al.
(Continued)

FOREIGN PATENT DOCUMENTS

FR 3051281 A1 11/2017
WO WO9741582 A1 11/1997

OTHER PUBLICATIONS

International Search Report of the International Searching Authority for PCT/EP2018/056436 dated May 18, 2018.
(Continued)

*Primary Examiner* — Jacob R Crum
(74) *Attorney, Agent, or Firm* — Matthew D. Thayne; Thayne and Davis LLC

(57) ABSTRACT

Pyrotechnic switch (1) including:
at least a first circuit portion (10) with two connection terminals (11*a*, 11*b*), arranged to be part of an electrical circuit,
a mobile body (20), arranged to pass from a first position to a second position, and thereby cause an opening of the first circuit portion (10),
a pyrotechnic actuator, arranged to control the movement of the mobile body (20) from the first to the second position,
a fuse element (30) such as a fuse, arranged to interrupt an electric current passing between the terminals of the
(Continued)

first circuit portion (11*a,* 11*b*), characterized in that the fuse element (30) is isolated from at least one of the terminals of the first circuit portion (11*a,* 11*b*) when the mobile body (20) is in the first position.

17 Claims, 4 Drawing Sheets

(56) References Cited

U.S. PATENT DOCUMENTS

| | | | | |
|---|---|---|---|---|
| 6,556,119 | B1 * | 4/2003 | Lell | H01H 39/006 337/157 |
| 2006/0049027 | A1 | 3/2006 | Iversen | |
| 2008/0137253 | A1 | 6/2008 | George et al. | |
| 2010/0219162 | A1 * | 9/2010 | Gentsch | H01H 39/004 218/121 |
| 2010/0328014 | A1 | 12/2010 | Suzuki et al. | |
| 2013/0126326 | A1 * | 5/2013 | Borg | H01H 15/06 200/547 |
| 2013/0220095 | A1 * | 8/2013 | Ukon | H01H 39/006 83/639.1 |
| 2014/0061161 | A1 | 3/2014 | Nakamura et al. | |
| 2016/0225558 | A1 * | 8/2016 | Chatroux | H01H 39/004 |
| 2016/0343524 | A1 | 11/2016 | Gaudinat et al. | |
| 2016/0351363 | A1 | 12/2016 | Gaudinat et al. | |
| 2017/0076890 | A1 | 3/2017 | Hori et al. | |
| 2018/0277325 | A1 | 9/2018 | De Palma et al. | |

OTHER PUBLICATIONS

Translation of the International Search Re;port of the International Searching Authority for PCT/EP2018/056436 dated May 18, 2018.

* cited by examiner

PYROTECHNIC SWITCH WITH A FUSE ELEMENT

This invention generally concerns a pyrotechnic switch with a fuse intended to be installed in a power distribution device, and in particular mounted on a motor vehicle.

In such power distribution devices or vehicles, it is necessary to provide a switch making it possible to isolate energy storage elements, such as electric batteries or capacitors, or energy consumption elements such as electric propulsion devices. Said switch can be operated for example either on demand, or following an anomaly on the distribution device, or following an accident involving the vehicle.

It is known in the prior art of pyrotechnic switches with a fuse element, such as those disclosed in US patent 2008/0137253.

On the other hand, this system has the disadvantage of proposing a parallel arrangement of the pyrotechnic part and the fuse element, so that an electric current, even a small one, can constantly flow through the fuse element, causing it to age prematurely and unnecessarily consuming energy, particularly when used with high voltages and/or currents. Indeed, the electric current flowing through the fuse element can cause overheating and weaken the fuse material by dilation and contraction, or in some cases even open the fuse element unintentionally. In addition, it can be difficult to detect an unwanted opening of the fuse element since the majority of the current passes through the electrical conductor of the pyrotechnic part. Therefore, in the event of a trip of the pyrotechnic part, the current will not be able to pass through the open fuse element, which can cause electrical arcing in the pyrotechnic part and destroy it.

One purpose of this invention is to address the disadvantages of the above-mentioned prior art document and in particular, first of all, to propose a pyrotechnic switch with a fuse element wherein the wear of the fuse element is reduced, as long as the pyrotechnic switch is not activated.

For this purpose, a first aspect of the invention concerns a pyrotechnic switch comprising:

- at least a first circuit portion with two connection terminals, arranged to be part of an electrical circuit;
- a mobile body, arranged to move from a first position to a second position, and thereby cause the first circuit portion to open;
- a pyrotechnic actuator, arranged to control the movement of the mobile body from the first to the second position;
- a fuse element such as a fuse, arranged to interrupt an electrical current passing between the connection terminals of the first circuit section, characterized in that the fuse element is isolated from at least one of the connection terminals of the first circuit portion when the mobile body is in the first position.

This makes it possible to propose a pyrotechnic switch with a fuse element, also called a circuit breaker, solving the stated technical problem. Indeed, the current cannot pass through the fuse element until the pyrotechnic actuator is tripped (since they are electrically isolated from at least one of the connection terminals of the first circuit section), in order not to unnecessarily wear out the fuse element and not to unnecessarily consume electrical energy. Therefore, such a switch benefits from an excellent reaction time thanks to the pyrotechnic actuator, which can typically be less than 1 ms for currents above 1000 A, combined with a high electrical switching capacity thanks to the fuse element. In other words, the fuse element can only be passed through by an electric current when the mobile body is in the second position Advantageously, the fuse consists of a wire or strip of metal or fusible alloy, mounted on an insulating body and connected to two connection pieces. The body may contain air, or a material intended to absorb the thermal energy released during melting: silica powder, insulating liquid, etc. The nature of the fuse metal varies according to the types of fuses and manufacturers (zinc, silver, aluminum, tin alloy, etc.). For example, Schurter offers an ASO reference fuse 10.3×38 that can cut off a current of 20 kA at 1000 V DC, and can for example be used to implement the invention.

Advantageously, the first circuit portion is designed to be sheared when moving from the first position to the second position.

This makes it possible to ensure that the opening of the first circuit portion is effectively completed and final.

Advantageously, the first circuit portion is opened (by shearing or cutting for example) by the mobile body when it passes from the first position to the second position, and it is the movement of the mobile body that connects the fuse element to the two connection terminals. In other words, it is the movement of the mobile body that causes (or forms or completes) a parallel connection of the fuse element with the first circuit portion, now open and always delimited by the two connection terminals. In particular, the mobile body when passing into its second position, opens the first circuit portion and causes or creates an electrical continuity between each connection terminal and one of the terminals of the fuse element.

In summary, when the mobile body is in its first position, the first circuit portion is continuous and conducts electricity between the two connection terminals, while the fuse element is isolated from at least one of the connection terminals: the current does not pass through this branch formed by the fuse element. When the mobile body is in the second position, the first circuit portion is open, interrupted and does not conduct electricity, while the fuse element now forms a series circuit with the two connection terminals.

Advantageously:

- in the first position of the mobile body, the first circuit portion comprises two conductors in physical contact, and
- the mobile body moves the two conductors away from each other when changing from the first position to the second position.

This allows for a pyrotechnic switch with high reliability and a robust design.

Advantageously, the fuse element is arranged to be in electrical contact with the connection terminals, when the mobile body is in the second position. In other words, there is physical contact, without an air gap.

This makes it possible to switch the current flow from the first circuit section to the fuse element very quickly, after the pyrotechnic actuator has been triggered. The pyrotechnic switch according to the invention allows the first circuit portion to be reliably cut off in less than 10 ms and even less than 5 ms, or even less than 1 ms. This physical cut-off is done permanently since the pyrotechnic actuator can only be used once. The fuse element then takes over to permanently disconnect the electrical circuit if the electrical current is higher than the calibration value.

This synergy between the pyrotechnic actuator and the fuse element allows for a pyrotechnic switch with a fuse element having a very fast reaction time for high currents and/or high voltages. Therefore, the pyrotechnic switch can be integrated into a power distribution device, with voltages ranging from 0 V to 600 V, preferably between 100 V and 1000 V and currents ranging from 0 A to 5000 A, preferably between 1000 A and 50000 A on high inductive loads, for example 2500 pH (micro-Henry) for an intensity of less than 500 A and for example 150 pH for an intensity of 5000 A, with time constants typically between 0.25 ms and 2 ms.

Advantageously, the fuse element is in electrical contact with the connection terminals through a conductive element connected to the mobile body, when the mobile body is in the second position.

This allows for a reliable pyrotechnic switch, the electrical contact of which is robustly secured when the pyrotechnic actuator is triggered, in particular to overcome the technical difficulties, in particular mechanical difficulties, associated with a rapid current switching from the first circuit portion to the fuse element.

Advantageously, the fuse element includes connection terminals, and:

in the first position, at least one of the connection terminals of the fuse element is at a predetermined distance from the first circuit portion;

in the second position, a conductor from the first circuit section has at least one open or broken end in physical contact with said at least one terminal for connecting the fuse element.

In other words, the first circuit portion is sheared by the mobile body as it passes from the first to the second position and one end that has just been sheared is pushed against a conductive element such as a conductor wire connected to the fuse element. This makes it possible to ensure a robust electrical and physical contact to allow the current to pass through the fuse element after the pyrotechnic actuator has been tripped. A broken or open end is defined as an end that has just been broken or opened by the mobile body by the pyrotechnic actuator. In other words, the first circuit portion is broken by tearing or plastic deformation beyond the breaking point. A fuse connection terminal is defined as a free end of a conductor of the fuse element.

Advantageously, the switch includes a second circuit portion electrically connected by the fuse element to a first connection terminal of the first circuit portion when the mobile body is in the first position.

This allows to propose a reliable pyrotechnic switch with economical design.

Advantageously, the second circuit portion is arranged to be connected to the second of the connection terminals of the first circuit portion when the mobile body is in the second position.

This allows to propose an efficient and inexpensive pyrotechnic switch.

Advantageously, a conductor from the first circuit section has at least one end that is broken or open when the mobile body is in the second position so that an electric current flows through the fuse element as an arc.

Advantageously, a conductor from the first circuit portion has at least one open end when the mobile body is in the second position, the open end being arranged at a predetermined distance from a fuse element connection terminal, and arranged to define an arc path between the at least one open end of the first circuit portion and the at least one fuse element connection terminal.

Advantageously, a conductor from the first circuit section has at least one end that is broken or open when the mobile body is in the second position, to cut off an electrical current supplied by the electrical circuit when it delivers a first level of energy to the connection terminals of the pyrotechnic switch without passing current through the fuse element;

and to pass through the arc fuse element an electrical current supplied by the electrical circuit when it delivers a second level of energy higher than the first level of energy at the connection terminals of the pyrotechnic switch.

This allows to propose a pyrotechnic switch with a reinforced breaking capacity, since the fuse element works in series with the pyrotechnic device thanks to the arc created between the open end and the fuse element. Therefore, the breaking capacity of the created arc is added to the breaking capacity of the fuse.

In addition, this allows to improve the breaking capacity of the pyrotechnic switch by cutting off electrical currents below a predetermined threshold in relation to the predetermined distance between the broken or open end and at the least one terminal of the fuse element. Indeed, a current below the threshold in question is not powerful enough or does not have enough energy to establish an electric arc over the predetermined distance. They are automatically switched off when the first section of the circuit is mechanically opened. As a result, low powers are switched off and high powers create an electric arc along said predetermined distance.

Advantageously, a conductor from the first circuit portion has at least one broken or open end when the mobile body is in the second position, and the fuse element comprises at least one connection terminal arranged at a predetermined distance from the broken end of the first circuit portion, so that when the first circuit portion is opened, an electrical arc can be established between said at least one broken first end and said at least one fuse connection terminal, allowing current to pass through the fuse element.

In other words, the first circuit portion is sheared or opened by the mobile body as it travels from the first to the second position and one end that has just been sheared or opened is pushed near a conductor wire connected to the fuse element, without touching it. Thus, the pyrotechnic actuator and the fuse element of the pyrotechnic switch are used for their own advantages: the controlled opening and low-power cut-offs for the pyrotechnic actuator in cooperation with the mobile body and the first circuit section, and high-power cut-offs for the fuse element, due to the good control of the electric arc.

Advantageously, the conductor above is connected to one of the connection terminals of the first circuit section.

This allows to propose a pyrotechnic switch with a fuse element in a compact design.

Advantageously, the pyrotechnic switch is arranged to define a path of an electric arc between the at least one broken or open end of the first circuit section and the at least one terminal for connecting the fuse element.

The path of the electric arc is thus designed in such a way that the electric arc or arcs are guided by a passage, which guarantees their location and limits the risk of damage to the rest of the pyrotechnic switch.

Advantageously, the pyrotechnic switch is arranged to define a path of an electric arc between at least one broken or open end of the first circuit portion and at least one terminal for connecting the fuse element and the pyrotechnic switch further comprises an ablative material arranged to increase an electric voltage of said electric arc.

This allows to propose a pyrotechnic switch with a fuse element having a high breaking capacity, particularly thanks to the ablative material.

In addition, the efficiency and breaking speed of the circuit is improved by the ablative material, which means that the material removed by ablation is sublimated by the action of the intense heat flow of the electric arc and its conductivity, which increases the electric arc voltage once the pyrotechnic actuator has operated. Such arcs occur when the pyrotechnic switch is connected to a live electrical circuit, with voltages ranging from 0 V to 1000 V and currents ranging from 0 A to 50000 A on inductive loads, for example 2500 pH (micro-Henry) for an intensity of less than 500 A and for example of 150 pH for an intensity of 5000 A. The pyrotechnic switch will be effective even at high voltage at its terminals, without increasing the gaps between the separate parts of the pyrotechnic switch, thus improving its compactness.

Advantageously, the mobile body can occupy or pass through a third position between the first position and the second position, and:

when the mobile body is in the third position, the first circuit portion is cut off or opened to form a separate first upstream portion, a separate first downstream portion and a separate first intermediate portion, the pyrotechnic switch is arranged to define a path of an electric arc between the first intermediate part and each of the first downstream portion and the first upstream portion.

In other words, the mobile body is arranged to cut or shear the first circuit portion into three separate parts to form a first upstream portion, a first downstream portion and a first intermediate portion. The downstream and upstream terms are defined according to an arbitrarily chosen current direction.

This allows to propose a pyrotechnic switch with a longer arc path to improve switching capabilities while maintaining a compact design. This also allows to define a current and/or voltage threshold below which the current flows preferentially through the first intermediate part and each of the first downstream portion and the first upstream portion through the arc path, rather than through the fuse element, isolated from the circuit, which has a safety advantage. In addition, it provides a fuse element which, as long as the switch is not activated, is completely isolated from the rest of the electrical circuit.

Advantageously, the pyrotechnic switch further comprises a stop piece, wherein the first circuit portion further comprises another broken or open end, and wherein the mobile body is arranged to contact the stop piece when the mobile body is in the second position, in order to obstruct the path of an electric arc between the at least one broken or open end of the first circuit portion and the other broken or open end, so as to force the electric current of the electric arc to pass through the fuse element.

Thus, the current can be cut off in three different ways, depending on the energy available at the terminals of the switch at the time of cutting-off: either by the first arc created between the at least one broken end of the first circuit portion and the other broken end;

either by the second arc created between at least one broken end and the fuse element without the fuse element opening;

or by opening the fuse element.

Advantageously, the other broken or open end belongs to a conductor of the first circuit portion, separated from the terminals of the first circuit portion when the mobile body is in the second position.

This allows to propose a pyrotechnic switch with increased reliability and compactness. In addition, this allows the current to be cut off even without passing through the fuse element if the current and/or voltage is not strong enough for an electrical arc to be established between the first circuit portion and the fuse element.

Advantageously, the ablative material is selected from a group consisting of polyoxymethylene (POM), polyethylene terephthalate (PET), polymethyl methacrylate (PMMA), polybutylene terephthalate (PBT), polyether sulfone (PESU), and polyamide 6-6 (PA6.6). Polyamide 6-6 (PA6.6) can be loaded with 30% of fiber glass.

According to this implementation, the material to be removed by ablation will create, during ablation, a gas mixture that increases the voltage of the electric arc. Indeed, polyoxymethylene (POM) has a very low ratio of the number of carbon atoms to the number of oxygen atoms, close to 1. The materials also mentioned have similar characteristics to increase the voltage of an electric arc, although the list can neither be considered restrictive nor exhaustive.

Advantageously, the path is delimited by at least one passage, and the material that can be removed by ablation is positioned near and preferably along the path.

This implementation increases the efficiency of the switch, as the material to be removed by ablation of the electric arc is located in its immediate vicinity, which ensures a rapid increase in the voltage of the electric arc due to the ablation of the material.

Advantageously, the fuse element is installed on the mobile body.

This improves the compactness of the switch.

Advantageously, the fuse element is a fuse.

A second aspect of the invention is a power distribution device comprising at least one pyrotechnic switch according to the first aspect of this invention.

This allows to propose a current distribution device, in particular with high currents and/or voltages, with a high switching capacity, in particular when using inductive loads in the current distribution device.

A third aspect is a motor vehicle with at least one pyrotechnic switch according to the first aspect of the invention.

A final aspect of the invention is a motor vehicle according to the previous aspect, comprising electrical energy storage means, such as a battery or super-capacitors and an electrical propulsion device connected to the electrical energy storage means through said at least one pyrotechnic switch according to the first aspect.

Other features and benefits of this invention will be seen more clearly from reading of the following detailed description of several embodiments of the invention, provided by way of a non-limiting example and illustrated by the appended drawings, wherein.

Figure 1:
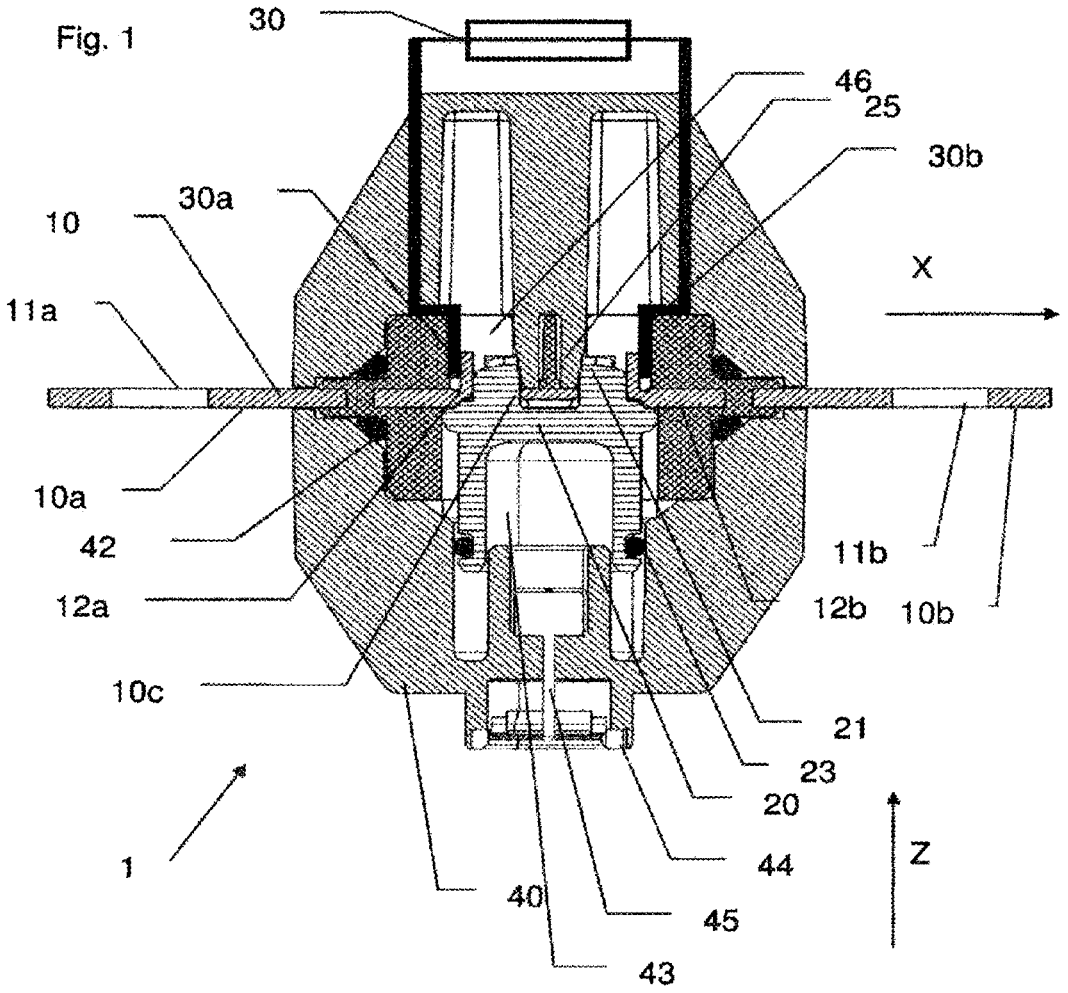
FIG. 1 shows a cross-sectional view of a pyrotechnic switch with a fuse element according to a first embodiment of this invention.

FIG. 1 shows a cross-sectional view of a pyrotechnic switch 1 with a fuse element, such as a fuse according to this invention. The pyrotechnic switch 1 includes a main body 40 used, among other things, as a housing and a first circuit section 10 made of conductive material, with two connection terminals 11*a* and 11*b*, arranged to be part of an electrical circuit. The pyrotechnic switch 1 also includes a mobile body 20 arranged to move from a first position, before tripping, to a second position, after tripping, along a Z axis, and thereby cause the first circuit portion 10 to open. The mobile body 20 is shown in FIG. 1 in the second position, wherein it has physically or mechanically sheared off the first circuit portion 10 into three separate electrical circuit portions, namely a first upstream portion 10*a*, a first downstream portion 10*b* and an intermediate portion 10*c*. The upstream and downstream terms are to be considered according to an electrical direction arbitrarily represented here by the X arrow. For better cutting the first portion 10, the mobile body 20 has a punch shape 21 with a beveled opening and comes to a stop in the second position against a die 25 of the main body 40.

The pyrotechnic switch 1 also includes a pyrotechnic actuator in the form of an electro-pyrotechnic igniter 45 arranged to control a movement of the mobile body 20 from the first to the second position. The electro-pyrotechnical igniter 45 is mounted or overmoulded on the fixing means 44 of the main body 40 of the pyrotechnic switch 1 and communicates with the combustion chamber 43. A pressurized gas from the pyrotechnic actuator is used to move the mobile body 20 from the first position, before tripping, at the bottom of the combustion chamber 43 to the second position, known as the after-trigger position, at the top of the combustion chamber 43 position wherein the mobile body 20 is represented when the pyrotechnic actuator has been triggered. Sealing elements 23 (e. g. an O-ring) mounted on the mobile body 20 complete the sealing of the combustion chamber 43.

In addition, the pyrotechnic switch 1 includes a fuse element 30 arranged to interrupt an electrical current passing between the terminals 11*a* and 11*b* of the first circuit portion 10 when the mobile body 20 is in the second position. Fuse element 30 is isolated from the terminals 11*a* and 11*b* when the mobile body 20 is in the first position, at the bottom of the combustion chamber 43.

In other words, the first circuit portion 10 is integrated before being cut off by the mobile body 20 and allows the current to pass between its terminals without passing through the fuse element 30, since the boundaries 30*a*, 30*b* are distant from the first circuit portion 10. When the mobile body 20 cuts the first portion 10 into three separate circuit portions and that it allows the covering (or physical contact) of the broken or open upstream ends 12*a* and downstream 12*b* from a conductor of the first circuit section 10 on the upstream terminals 30*a* and downstream 30*b*, respectively, of the fuse element 30, the electrical power can be restored, by passing through the fuse element 30.

The time required to cut off the first circuit portion 10 also known as a busbar, and the folding of broken or open upstream ends 12*a* and downstream 12*b* on the upstream terminals 30*a* and downstream 30*b* of the fuse element 30 is typically less than 0.1 ms. Sealing means 42, such as O-rings, guarantee the tightness of the switching chamber 46 of the main body 40. An IP67-grade tightness can be achieved, as defined in DIN4050, IEC 60529 or BS 5490. Finally, the fuse element 30 can be overmoulded on the main body 40.

Figure 2:
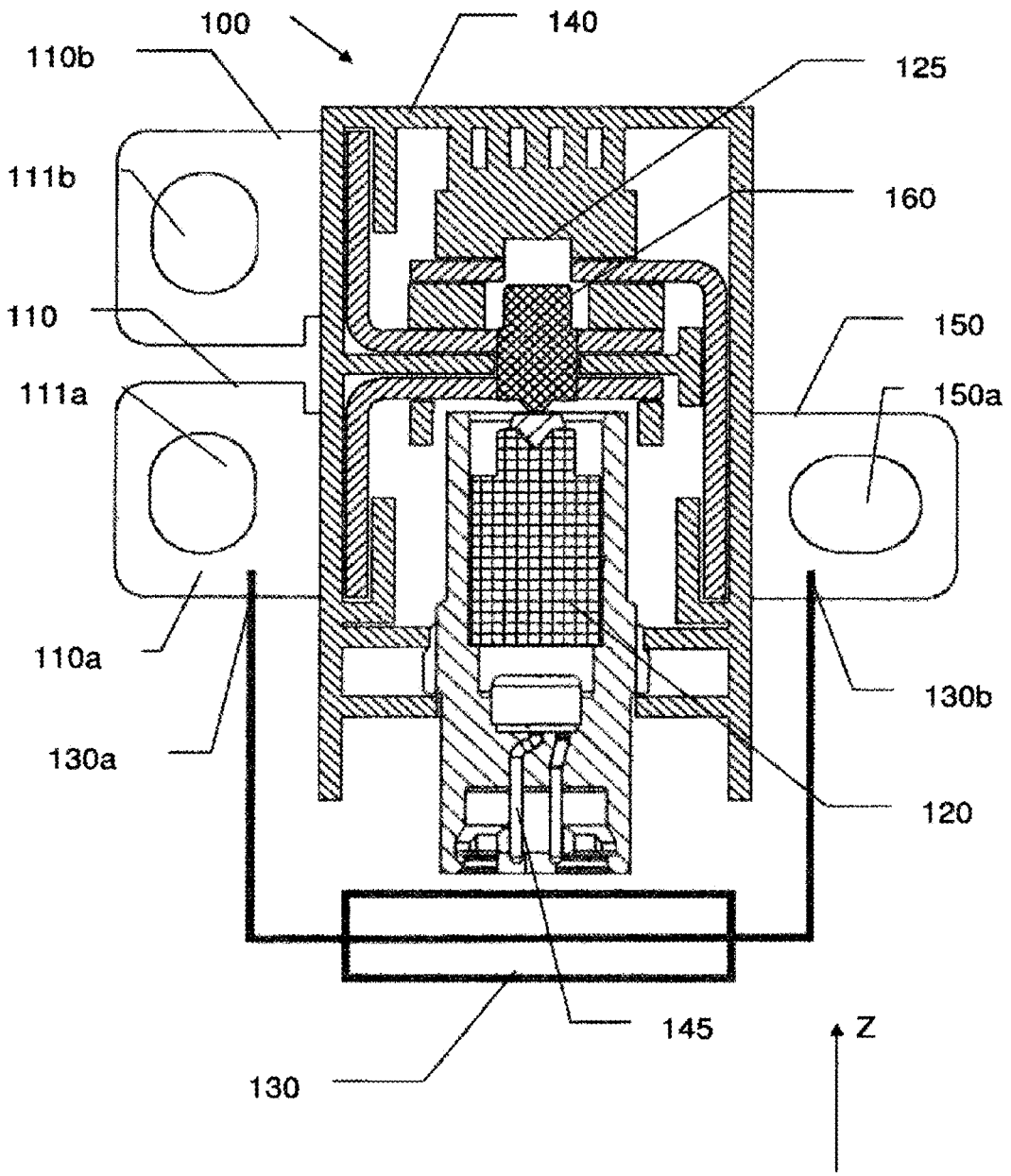
FIG. 2 shows a cross-sectional view of a pyrotechnic switch according to a second embodiment of this invention

FIG. 2 shows a cross-sectional view of a pyrotechnic switch 100 according to a second method of carrying out this invention. The pyrotechnic switch 100 includes a main body 140 used, among other applications, as housing and a first portion of an electrical circuit 110 with two upstream connection terminals 111*a* and downstream 111*b*, respectively, of the upstream portions 110*a* and downstream 110*b*, respectively, of the first portion 110 which is arranged to be part of an electrical circuit. The switch 100 also includes a second circuit portion 150 made of conductive material and a fuse element 130 arranged to connect one of the terminals 111*a* from the first circuit portion to a terminal 150*a* of the second portion 150.

The pyrotechnic switch 100 also includes a mobile body 120 arranged to pass, respectively, from a first position, before tripping, wherein it is shown in FIG. 2 at a second position, after tripping, and thus cause a contactor 160 to move along a Z axis of a substantially cylindrical shape in a preferred mode of execution. The contactor 160 electrically conductive, allows the upstream portion to be electrically connected 110*a* to the downstream portion 110*b* when the mobile body 120 is in the first position. Moving the contactor 160 also takes place from a first position of the contactor 160 to a second position wherein the contactor 160 comes to a stop on the stop 125 of the main body 140.

In other words, when the contactor 160 is in the first position, it electrically connects the terminals 111*a* and 111*b* of the first circuit portion 110 without going through the second circuit portion 150 or by the fuse element 130. When the contactor 160 is in the second position, it electrically connects the terminals 111*a* and 111*b* of the first portion 110 through the second circuit portion 150 and by the fuse element 130.

In a way comparable to the first embodiment, the mobile body 120 is set in motion on demand by means of a pressurized gas from the pyrotechnic actuator 145 fixed to the main body 140.

Figure 3:
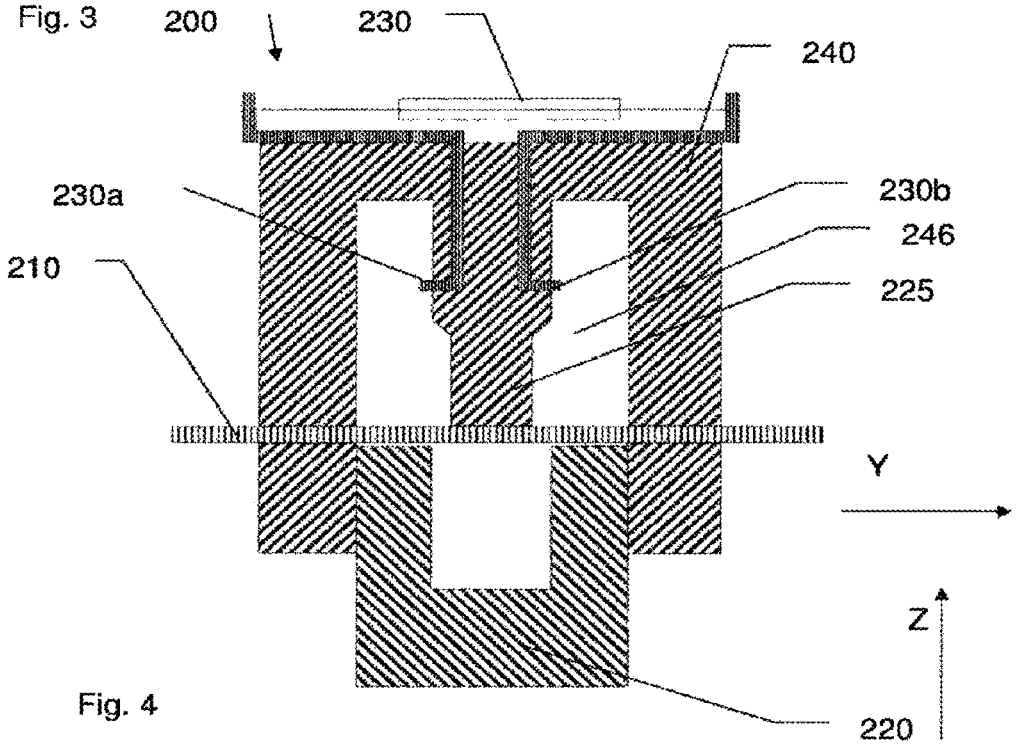
FIG. 3 shows a cross-sectional view of a switch in a third design mode, wherein a mobile body is in a first position.

FIG. 3 shows a cross-sectional view of a switch 200 according to a third embodiment, wherein a mobile body 220 is in a first position. The pyrotechnic switch 200 includes a main body 240 serving, among other things, as a housing, a first portion of an electrical circuit 210 arranged to be part of an electrical circuit. The switch 200 also includes a cut-off chamber 246 of the main body 240 and fuse element 230 with upstream 30*a* and downstream 230*b* terminals, according to an arbitrary electrical direction Y. The mobile body 220 is arranged to move from a first position, known as the pre-trigger position, to a second position, after tripping, along a Z axis, under the effect of an pyrotechnic actuator (not shown). The main body 240 includes a die or stop 225 to stop the movement of the mobile body 220.

Figure 4:
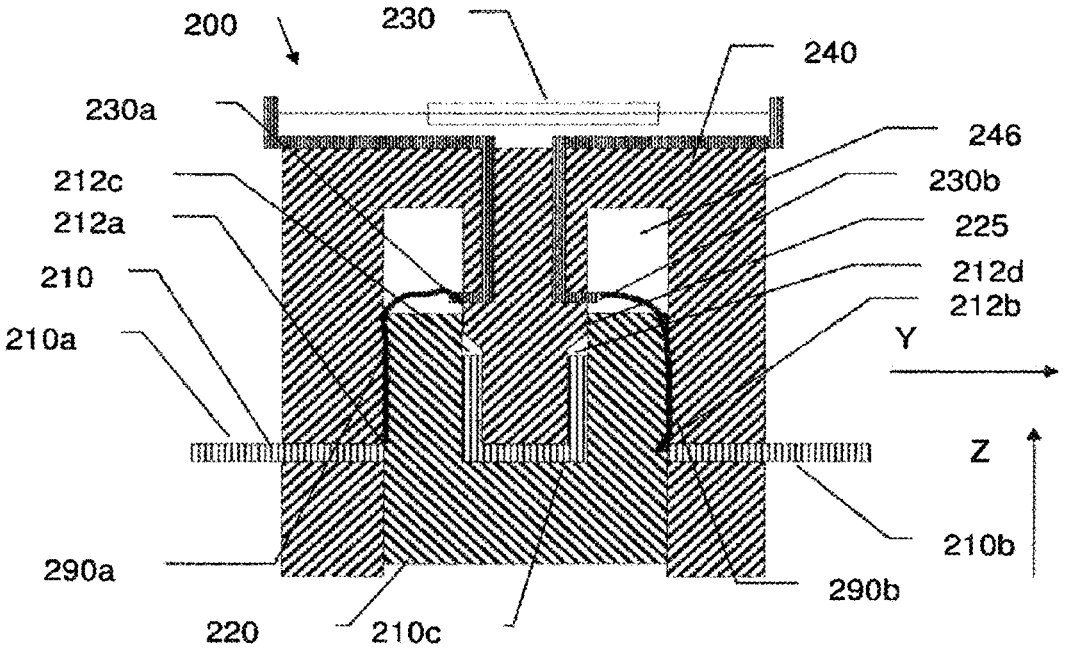
FIG. 4 shows a cross-sectional view of the switch in the third mode of execution, wherein the mobile body is in a second position.

FIG. 4 shows a cross-sectional view of the switch 200 according to the third embodiment, wherein the mobile body is in a second position. When the mobile body 220 is set in motion by the pyrotechnic actuator along a Z axis, it cuts the first circuit portion 210 which then has three separate portions: a first downstream portion 210*b*, a first upstream portion 210*a*, according to an arbitrary electrical direction Y, and a first intermediate portion 210*c*, as well as broken or open ends 212*a*, 212*b*, 212*c* and 212*d*.

When mobile body 220 is in the second position, and if the voltage and/or current are sufficient, as defined for example in the above ranges of use, an electric arc 290*a* is established between the broken or open end 212*a* of the first upstream circuit portion 210*a* and the terminal 230 has a fuse element 230 as well as an electric arc 290*b* between the broken or open end 212*b* of the first downstream portion 210*b* and the terminal 230*b* of the fuse element 230. The current then flows through the fuse element 230 to protect the circuit.

The electric arc 290*a*, 290*b* can also be weakened if its path or passage is forced between the walls covered with ablative material of the mobile body 220 and the switching chamber 246. In this case, the ablative material thus increases the voltage of the electric arc 290*a*, 290*b*. This is achieved, for example, by adjusting the dimensions to have a very small operating clearance between the mobile body 220 and the cut-off chamber 246 of the main body 240 with also a groove along the mobile body 220 that guides the electric arc 290*a*, 290*b*. It should be noted that the operating clearance may condition the amount of material removed by ablation. The smaller the size of the groove forming the passage, the greater the erosion. Good results are obtained with a groove of 0.1 to 1 mm, and a depth of 0.1 to 1 mm.

When the mobile body 220 is in an intermediate position, also known as the third position, between the first position and the second position, electric arcs can be created between the broken end 212*a* of the first upstream portion 210*a* and the broken end 212*c* of the first intermediate portion 210*c*, as well as between the broken end 212*b* of the first downstream portion 210*b* and the broken end 212*d* of the first intermediate portion 210*c*. Depending on the electrical power to be cut off, the current can be cut off from this third position if the reached arc voltage is higher than the voltage at the terminals of the pyrotechnic switch 200. Therefore, the fuse element 230 will not see power flow and will not work.

When the mobile body 220 is in the second position, it is at the stop on the die 225 which obstructs the path of the arcs from the third position and the arcs, if they are still present (e.g, their voltage is lower than the voltage at the terminals of the pyrotechnic switch 200), are forced to move towards the bollards 230*a* and 230*b* of the fuse element 230 from the broken ends 212*a* and 212*b* of the first portion 210 thanks to a tight fit of the mobile body 220 and the stop 225. This tight fit provides a good seal, which forms a natural barrier against the passage of electrical arcs between the broken ends 212*a*, 212*b*, 212*c*, 212*d* described in the intermediate position. A negative clearance of 0 to 0.3 mm between the mobile body 220 and the die 225 can be considered at the desired location to cut the path of the electric arcs of the first intermediate portion 210*c*. The breaking capacity of the fuse element 230 and the electric arcs 290*a*, 290*b* are therefore added, achieving a synergy between the fuse element 230 and the pyrotechnic actuator in cooperation with the mobile body 220. Indeed, the third position can be pre-dimensioned to cut off low powers while the fuse element 230 can be sized to cut off high powers. Thus, the fuse element 230 will not have to operate over a very wide range of currents, which are supported by the fuse element, particularly in terms of break times, which are very different.

Figure 5:
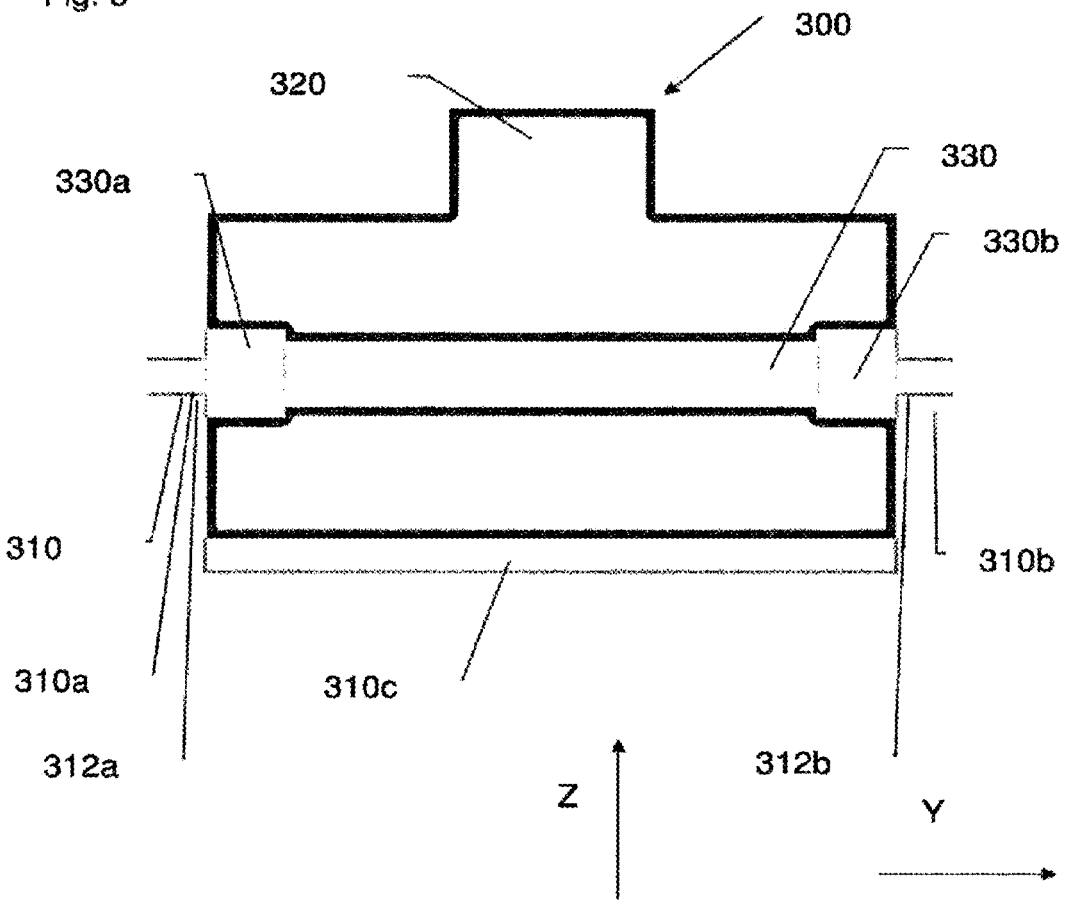
FIG. 5 shows a schematic view of a switch in a fourth mode of execution, wherein a mobile body is in the second position.

FIG. 5 shows a schematically represented view of a switch 300 according to a fourth embodiment, wherein a mobile body is in the second position.

The pyrotechnic switch 300 includes a mobile body 320 represented in the second position and a first portion of the electrical circuit 310. When the mobile body 320 moves from the first position to the second position along a Z axis, it cuts the first portion of the electrical circuit 310 which is then divided into separate portions: a first upstream portion 310*a*, a first downstream portion 310*b*, downstream and upstream being to be considered in a direction Y that is arbitrarily represented, and a first intermediate portion 310*c*. The mobile body 320 includes a fuse element 330 with terminals 330*a* and 330*b* located upstream and downstream, respectively.

When the mobile body 320 moves from the first to the second position, the terminals 330*a* and 330*b* fuse element 330 come into contact with broken or open ends 312*a* and 312*b*, respectively, of the first upstream 310*a* and downstream 310*b* portions of electrical circuits. The electrical current can now pass through the fuse element 330 when the mobile body 320 is in the second position, when it could not pass through the fuse element 330 when the mobile body 320 in the first position was not engaged with the first portion of the electrical circuit 310.

It will be understood that various modifications and/or improvements, evident to those skilled in the art, can be made to the different embodiments of this invention as described in this description, without going beyond the scope of the invention as defined by the appended claims. In particular, reference is made to the possibility of changing the ablative material, overmolding the fuse element on the main body, or using a mobile body with only one branch instead of two branches in order to reduce the number of broken ends of the first portion of the electrical circuit. Similarly, it is possible to provide a first circuit portion previously broken or cut, the electrical contact being ensured by physical overlapping before the pyrotechnic actuator is triggered and the open end being moved under the action of the mobile body after the pyrotechnic actuator is triggered.

The invention claimed is:

1. A pyrotechnic switch comprising:

at least a first circuit portion with two connection terminals, arranged to be part of an electrical circuit, a mobile body, arranged to pass from a first position to a second position, and thereby cause the first circuit portion to open, a pyrotechnic actuator, arranged to control the movement of the mobile body from the first to the second position, at least one fuse element arranged as part of the pyrotechnic switch, wherein the at least one fuse element is configured to interrupt an electrical current flowing between the connection terminals of the first circuit portion, wherein the at least one fuse element is isolated from at least one of the two connection terminals of the first circuit portion when the mobile body is in the first position, and wherein the mobile body is configured to electrically connect the at least one fuse element with both the two connection terminals as a result of movement of the mobile body between the first position and the second position.

2. The pyrotechnic switch according to claim 1, wherein the first circuit portion is arranged to be sheared when passing from the first position to the second position.

3. The pyrotechnic switch according to claim 1, wherein:

in the first position of the mobile body, the first circuit portion includes two conductors in physical contact, the mobile body moves the two conductors away from each other when changing from the first position to the second position.

4. The pyrotechnic switch according to claim 1, wherein the fuse element is arranged to be in electrical contact with the connection terminals, when the mobile body is in the second position.

5. The pyrotechnic switch according to claim 4 wherein the fuse element is in electrical contact with the connection terminals via a conductive element connected to the mobile body, when the mobile body is in the second position.

6. The pyrotechnic switch according to claim 4, wherein the fuse element comprises connection terminals, and wherein:

in the first position, at least one of the connection terminals of the fuse element is at a predetermined distance from the first circuit section, in the second position, a conductor from the first circuit portion has at least one open end in physical contact with said at least one connection terminal of the fuse element.

7. The pyrotechnic switch according to claim 1, wherein the switch comprises a second circuit portion electrically connected by the fuse element to a first connection terminal of the first circuit portion when the mobile body is in the first position.

8. The pyrotechnic switch according to claim 7, wherein the second circuit portion is arranged to be connected to the second connection terminal of the first circuit portion when the mobile body is in the second position.

9. The pyrotechnic switch according to claim 1, wherein a conductor from the first circuit portion has at least one open end when the mobile body is in the second position, the open end being arranged at a predetermined distance from a connection terminal of the fuse element, and arranged to define a path of an electric arc between at least one open end of the first circuit portion and at least one connection terminal of the fuse element.

10. The pyrotechnic switch according to claim 9, further comprising a stop piece, wherein the first circuit portion further comprises another open end, and wherein the mobile body is arranged to contact the stop piece when the mobile body is in the second position, to obstruct the path of an electric arc between the at least one open end of the first circuit portion and another open end, so as to force the electric current of the electric arc to pass through the fusible element.

11. The pyrotechnic switch according to claim 9 wherein the mobile body can occupy or pass through a third position between the first position and the second position, wherein:

when the mobile body is in the third position, the first circuit portion is cut out to form a separate first upstream, a separate first downstream and a separate first intermediate portion, the Pyrotechnic Switch is arranged to define a path of an electric arc between the first intermediate part and each of the first downstream portion and the first upstream portion.

12. The pyrotechnic switch according to claim 1, wherein the fuse element is installed on the mobile body.

13. A power distribution device comprising the pyrotechnic switch according to claim 1.

14. A motor vehicle comprising at least one pyrotechnic switch according to claim 1.

15. The motor vehicle according to claim 14, wherein the motor vehicle comprises at least one electrical energy storage element, such as a battery or super-capacitors and an electrical propulsion device connected to the electrical power storage element through the at least one pyrotechnic switch.

16. A pyrotechnic switch comprising:

at least a first circuit portion with two connection terminals, arranged to be part of an electrical circuit;

a mobile body, arranged to pass from a first position to a second position, and thereby cause the first circuit portion to open;

a pyrotechnic actuator, arranged to control the movement of the mobile body from the first to the second position; and at least one fuse element arranged to interrupt an electrical current flowing between the connection terminals of the first circuit portion, wherein the at least one fuse element is isolated from at least one of the two connection terminals of the first circuit portion when the mobile body is in the first position, wherein the mobile body is configured to electrically connect the at least one fuse element with at least one of the two connection terminals as a result of movement of the mobile body between the first position and the second position such that when the mobile body is in the second position, an electric arc electrically connects the at least one fuse element with at least one of the two connection terminals.

17. A pyrotechnic switch comprising:

at least a first circuit portion with two connection terminals, arranged to be part of an electrical circuit;

a mobile body, arranged to pass from a first position to a second position, and thereby cause the first circuit portion to open;

a pyrotechnic actuator, arranged to control the movement of the mobile body from the first to the second position; and at least one fuse element arranged to interrupt an electrical current flowing between the connection terminals of the first circuit portion, wherein the at least one fuse element is isolated from at least one of the two connection terminals of the first circuit portion when the mobile body is in the first position, wherein the mobile body is configured to electrically connect the at least one fuse element with at least one of the two connection terminals as a result of movement of the mobile body between the first position and the second position, and wherein the first circuit portion is configured to be sheared when passing from the first position to the second position such that at least one sheared portion electrically couples the at least one fuse element with at least one of the connection terminals.

* * * * *